United States Patent [19]

Cheynet

[11] 4,176,530

[45] Dec. 4, 1979

[54] DEVICE FOR COVERING WARP YARN WITH COVERING YARNS

[76] Inventor: Claudius Cheynet, 18 rue Nationale, 43240 Saint Just Malmont, Haute-Loire, France

[21] Appl. No.: 579,327

[22] Filed: May 20, 1975

Related U.S. Application Data

[63] Continuation-in-part of Ser. No. 324,075, Jan. 16, 1973, abandoned.

[30] Foreign Application Priority Data

Jan. 4, 1972 [FR] France ..... 72.00862
Dec. 7, 1972 [FR] France ..... 72.44087

[51] Int. Cl.[2] ..... D04B 23/06; D03D 15/08

[52] U.S. Cl. ..... 66/203; 66/193; 139/1 R; 139/35; 139/421

[58] Field of Search ..... 139/35, 1 R, 426 R, 139/11, 420 R, 383 B, 421; 66/1 R, 86 R, 120, 85, 169, 202, 193, 87, 195, 203, 204; 57/152, 163

[56] References Cited

U.S. PATENT DOCUMENTS

| | | | |
|---|---|---|---|
| 1,860,030 | 5/1932 | Hinchliff | 57/163 X |
| 2,020,197 | 11/1935 | Meiwald | 66/169 X |
| 2,064,074 | 12/1936 | McNamee | 66/169 |
| 2,137,692 | 11/1938 | Linke | 66/193 |
| 2,143,230 | 1/1939 | Seim | 66/1 R |
| 2,213,720 | 9/1940 | Seim | 66/1 R |
| 2,596,246 | 5/1952 | Johnson et al. | 139/1 R |
| 3,099,907 | 8/1963 | Masurel et al. | 57/328 |
| 3,600,907 | 8/1971 | Miskovsky | 66/66 |
| 3,748,874 | 7/1973 | Blezard | 66/86 R |
| 3,808,840 | 5/1974 | Blezard et al. | 66/87 |

FOREIGN PATENT DOCUMENTS

| | | | |
|---|---|---|---|
| 473934 | 3/1929 | Fed. Rep. of Germany | 66/193 |
| 480735 | 6/1916 | France . | |
| 753941 | 8/1933 | France . | |
| 1352359 | 1/1964 | France . | |
| 1448289 | 6/1966 | France . | |
| 1459651 | 10/1966 | France . | |
| 345717 | 5/1960 | Switzerland . | |
| 257827 | 9/1926 | United Kingdom . | |
| 758533 | 10/1956 | United Kingdom . | |
| 779279 | 7/1957 | United Kingdom . | |
| 790851 | 2/1958 | United Kingdom . | |
| 1005592 | 9/1965 | United Kingdom . | |
| 1195466 | 6/1970 | United Kingdom . | |

*Primary Examiner*—James Kee Chi
*Attorney, Agent, or Firm*—Haseltine, Lake & Waters

[57] ABSTRACT

Covered warp yarns or cords are produced by feeding to a warp-knitting device thick warp yarns, especially of elastomeric material, and thin yarns which are knitted around the respective thick warp yarns as rows of chain or other loop stitches. The warp cords so produced are woven as warp threads in a conventional manner with weft threads in a loom which preferably includes the warp-knitting device.

4 Claims, 10 Drawing Figures

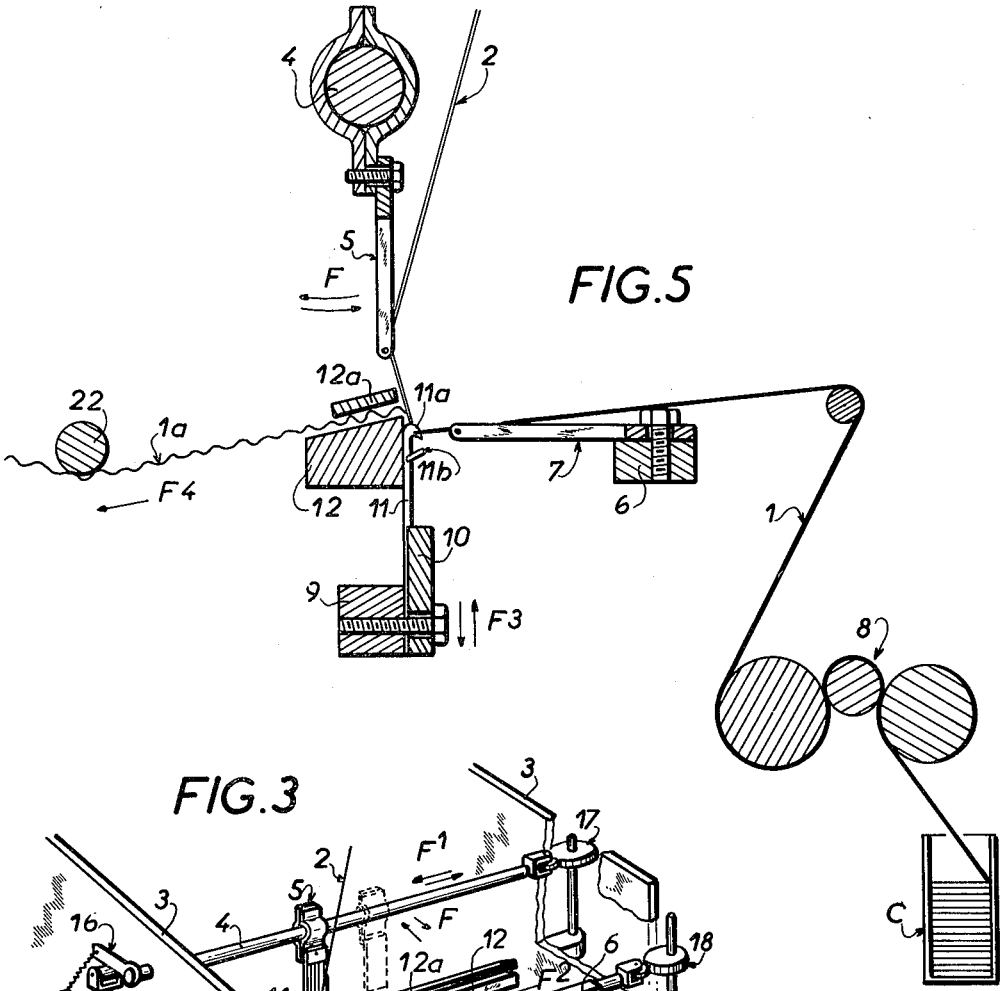
FIG.5
FIG.3
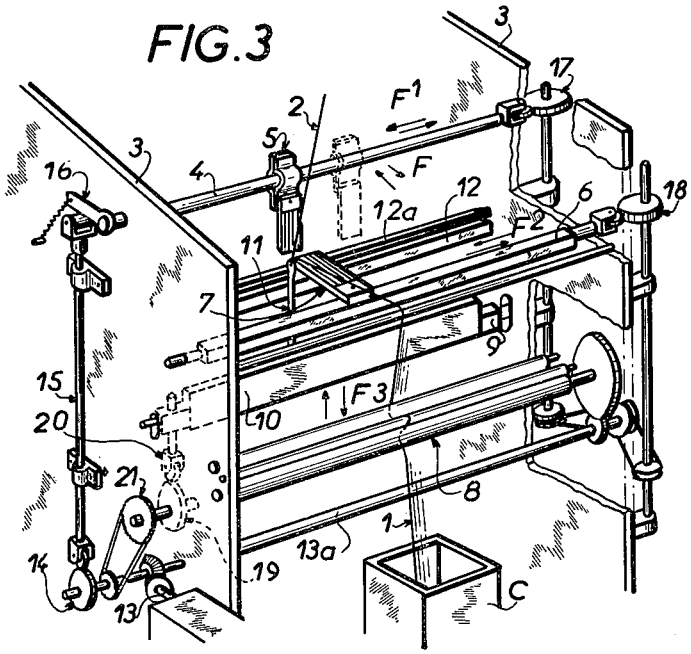

DEVICE FOR COVERING WARP YARN WITH COVERING YARNS

CROSS-RELATED APPLICATION

This application is a continuation-in-part of copending application Ser. No. 324,075 (now abandoned) filed Jan. 16, 1973 and claiming the priority of the applications filed in France on Jan. 4, 1972 and Dec. 7, 1972.

BACKGROUND OF THE INVENTION

1. Field of the Invention

The invention relates to an apparatus for the production of covered warp yarns for textile fabrics, and to the fabric produced thereby.

2. Description of the Prior Art

In order to weave, on high output shuttleless looms, tapes and other textile fabrics wherein covered yarns are used, it is necessary before weaving to carry out the covering operation, i.e. to wrap about the yarns to be covered coverings of textile material. Such covering is conventionally effected by helically winding a covering yarn about each yarn to be covered.

For this purpose, it is necessary to utilize costly equipment. Taking account of the labor necessary, of the space occupied in the mill, and of the various manipulations and handling operations required, it appears that the covering currently doubles the basic price of the yarn to be covered, particularly when the yarn is a rubber filament.

Such known covering, despite the precautions taken, also results in differences in tension in the covered yarns, in particular if these yarns are elastic filaments, and consequently snarling, kinking and undulation effects in the woven articles.

SUMMARY OF THE INVENTION

According to one aspect of the present invention, there is provided a method of producing a textile fabric, comprising covering warp yarns with covering yarns while said warp yarns are in a loom, and weaving the thus covered warp yarns with weft yarns while said warp yarns are in the loom.

According to another aspect of the present invention, there is provided apparatus for producing a textile fabric, comprising a loom, covering means in said loom for covering the warp yarns with covering yarns, and weaving means in said loom for weaving the thus covered warp yarns with weft yarns.

According to a further aspect of the present invention, there is provided a device for covering warp yarns with covering yarns, comprising a longitudinally reciprocable row of yarn guides for the respective warp yarns, a reciprocable row of needles extending substantially parallel to said row of yarn guides, and a longitudinally reciprocable row of covering yarn displacing members extending substantially parallel to said row of yarn guides for cooperating with said row of needles to cover said warp yarns with said covering yarns in the form of rows of loop stitches.

According to a yet further aspect of the present invention, there is provided a woven fabric comprising weft yarns, warp yarns and covering yarns covering said warp yarns, said covering yarns being in the form of rows of loop stitches which were applied to said warp yarns prior to weaving of said weft yarns and said warp yarns.

By means of the invention, it is possible to obtain articles of improved strength, greater stability and neat appearance. Moreover, they may incorporate surface effects of various kinds.

BRIEF DESCRIPTION OF THE DRAWINGS

In order that the invention may be clearly understood and readily carried into effect, reference will now be made, by way of example, to the accompanying drawings, in which:

FIG. 3 is a diagrammatic perspective view of the rear of a loom including a covering device, FIG. 5 is a diagrammatic sectional view of the covering device.

DETAILED DESCRIPTION OF THE PREFERRED EMBODIMENTS

Figure 1:
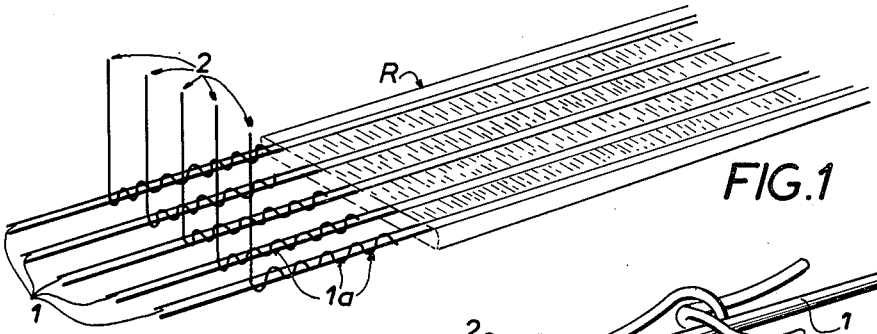
FIG. 1 is a diagrammatic perspective view illustrating a method of production of a woven tape.
Figure 2:
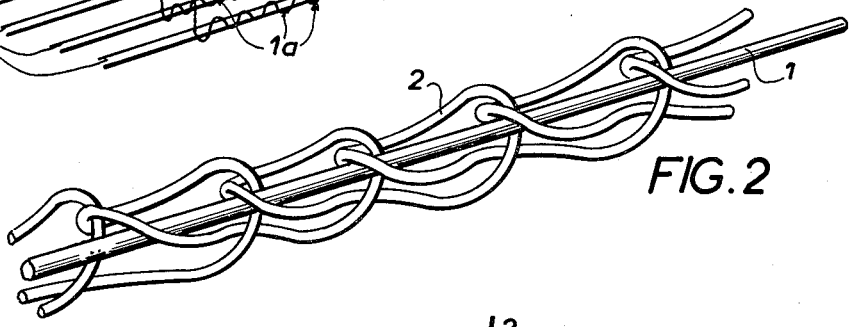
FIG. 2 is a perspective view illustrating, to an extremely large scale, a warp yarn covered by a covering yarn.

The woven tape R shown in FIG. 1 comprises warp yarns 1 each covered with a covering yarn 2, which covering yarn 2 surrounds the warp yarn in chain stitches. The warp yarns 1 are rubber filaments.

The formation of tape R is effected in a high-output shuttleless loom, in this case a loom having one or more sickle-shaped weft inserters, for example of the kind disclosed in British Patent Specification No. 1274546. However, it is not excluded that the method could be performed on a shuttle loom.

Figure 4:
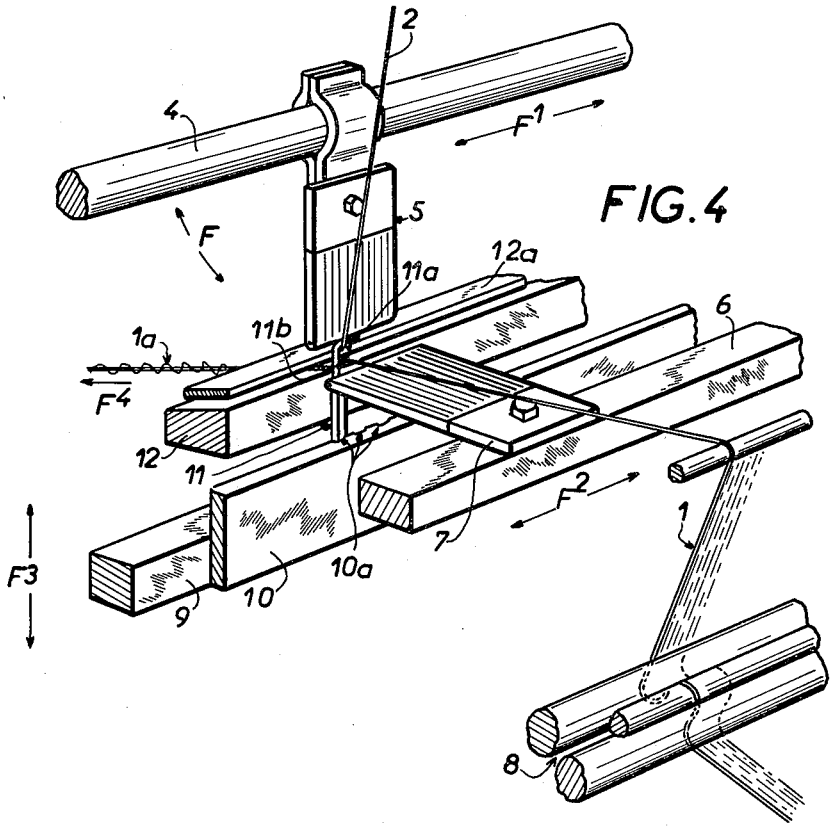
FIG. 4 shows a detail of FIG. 3, and in particular the covering device.

The tape R is woven on the loom which at the rear thereof includes a covering device. FIG. 3 shows lateral frame members 3 of the loom which carry a weftwise bar 4 which supports yarn-displacing members in the form of yarn guides 5 for the covering yarns 2. The bar 4 is angularly displaceable to-and-fro as indicated by the arrows F, and is longitudinally reciprocable as indicated by arrows F1. For the sake of clearness, only one block of yarn guides 5 for one tape is shown in FIGS. 3 to 5. A weftwise bar 6, carried by the frame members 3 of the loom, mounts eyed yarn guides 7, only one block of which is shown in the drawings, for the warp yarns to be covered. The bar 6 is longitudinally reciprocable as indicated by arrows F2. The yarns 1 are disposed, provisionally sized, in the form of a band, in a container C. Before travelling to the bar 6 and the yarn guides 7, the yarns 1 pass through a positive feed means 8, the rollers of which rotate at greatly reduced speed imparted, through optional intermediate means, by the driving mechanism of the loom.

The lateral frame members 3 of the loom also carry a weftwise bar 9 on which is secured a needle-clamping plate 10. Positioned in slots 10*a* of the plate are latch needles 11 each terminating at its upper end in a hook 11*a* and having a latch 11*b*. The bar 9 is reciprocable lengthwise of the needles as indicated by arrows F3.

A weftwise bar 12 which extends proximate the upper ends of the needles 11, is carried by the lateral frame members 3. A guiding and retaining plate 12*a* secured to the bar 12 above that bar serves with the bar as a guide for feeding covered warp yarns 1*a* from the covering device to the weaving means of the loom. As already noted, the weaving means of the loom includes a sickle-shaped weft inserter system.

There are as many groups of needles and yarn guides as there are tapes.

Save for the bar 12, which is fixed, the weftwise bars 4, 6 and 9 are fitted with the necessary clearance or play in sliding and/or pivoting bearings in the frame members 3 of the loom. In order to achieve the various displacements indicated in respect of the bars 4, 6 and 9, movement take-off is effected from the driving mechanism of the loom via a take-off shaft 13.

There is driven from a counter shaft 13*a*, itself driven from the take-off shaft 13, a cam 14, which acts to displace vertically a connecting rod 15. The latter periodically urges a lever 16, keyed on the end of the bar 4, against the action of a spring so as to produce the angular to-and-fro displacements of the bar 4. To the other end of the bar 4 there is imparted, by a cam 17, the longitudinal reciprocation of that bar, and return is provided by a return spring (not shown). The cam 17 is driven from the counter shaft 13*a*.

The longitudinal reciprocation of the bar 6 is produced by a cam 18 acting under driving means similar to those of the cam 17 and having a return spring (not shown).

The reciprocation of the bar 9 lengthwise of the needles 11 is obtained by means of cams 19, only one of which is shown, acting at the ends of the bar, against respective followers 20. A shaft upon which the cams 19 are mounted is driven by means of a chain 21 from the counter shaft 13*a*.

These various displacements are, of course, appropriately synchronized and coordinated so as to form the chain stitches in covering yarns 2 about the elastic filaments 1.

The velocity of the displacements may be varied in such a manner as to obtain more or less tight covering of the warp yarns 1. In this way, it is possible to modify the appearance of the covered yarns and of the woven article, thereby imparting to them a thicker, more considerably "bulked" or more costly appearance, even if the covering yarns are extremely fine.

Upon leaving the covering device, the covered yarns 1*a* pass around a roller 22, thus to be directed, as indicated by arrow F4, towards the weaving means of the loom where the covered warp yarns are woven with the weft threads.

The articles thus woven are, furthermore, neater and more uniform, owing to the uniformity of the rubber filaments which are covered simultaneously, starting from the same initial tension, such tension not being substantially modified during the operations. There is substantially no deformation, buckling or snarling in the articles produced by considerable variations in the tension in the covered filaments.

Figure 6:
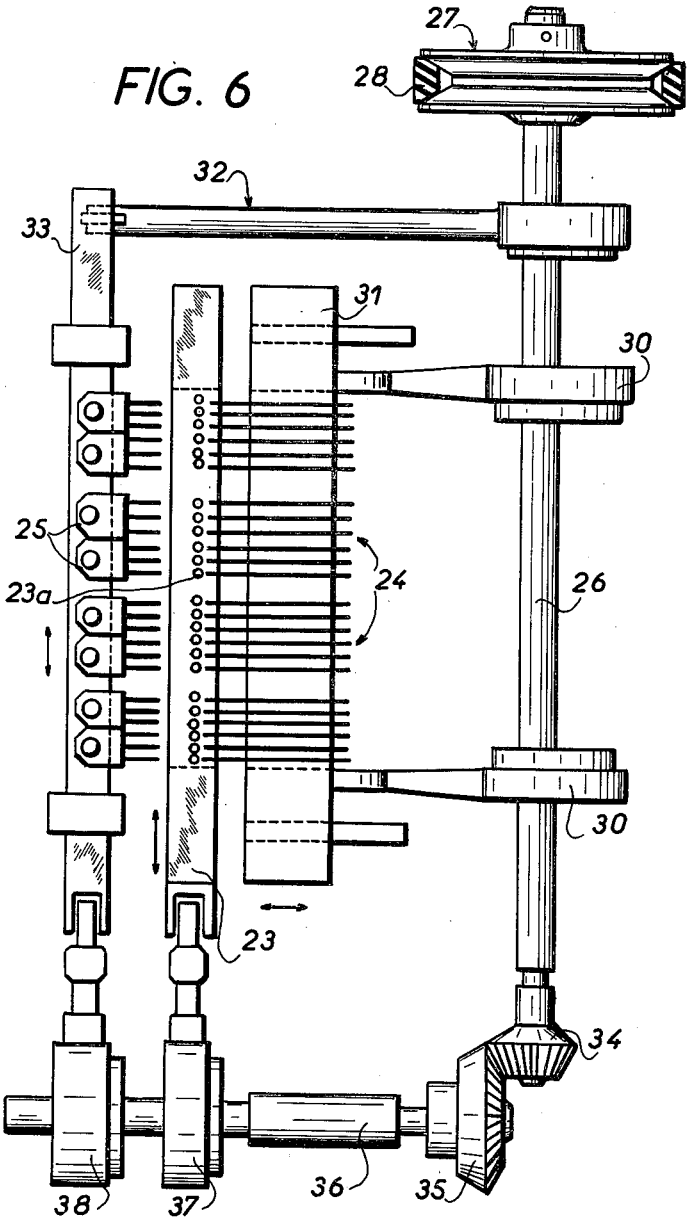
FIG. 6 is a diagrammatic plan view of a modified version of the covering device.
Figure 7:
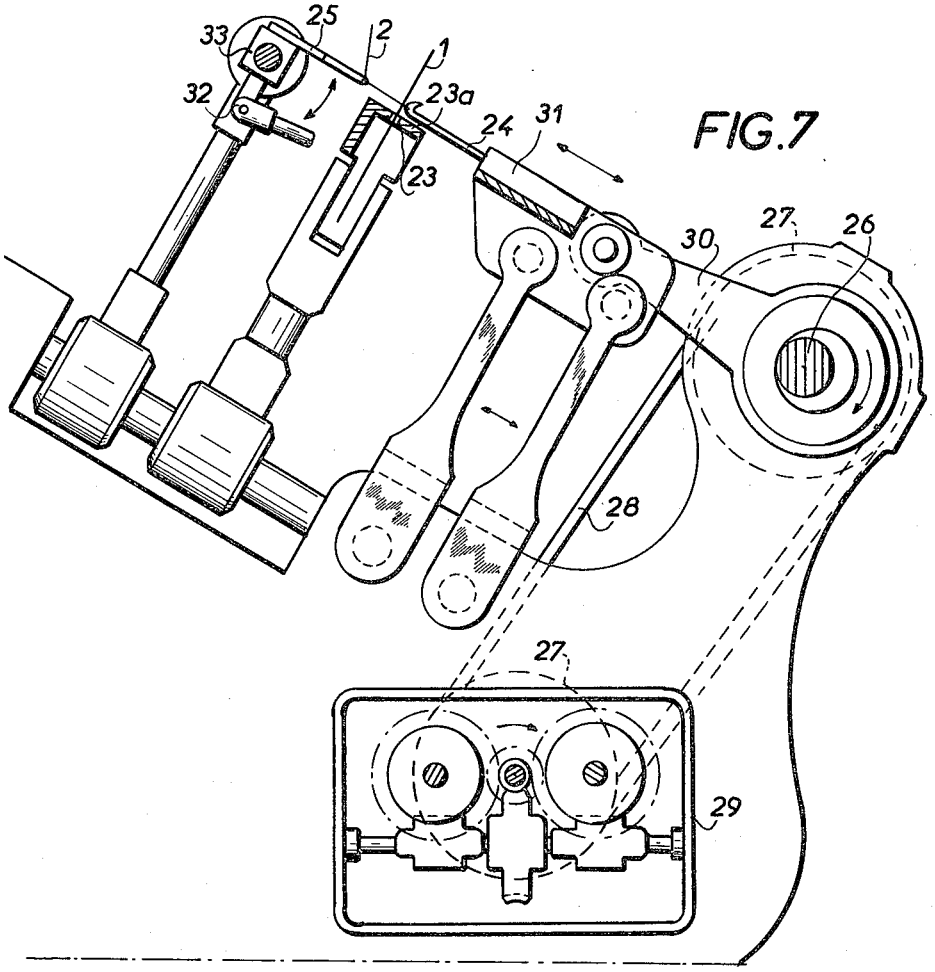
FIG. 7 is a diagrammatic sectional view of the modified version.

Referring to the modified form of covering devices shown in FIGS. 6 and 7, the weftwise bar 6 and the yarn guides 7 of the above described covering device are replaced by a single angle member 23 which is formed with a series of orifices 23*a* for the passage of the warp yarns 1. The member 23 is disposed between a row of needles 24, mounted on a weftwise bar 31, and a row of yarns guides for the covering yarns. These guides are arranged in blocks 25 mounted on a weft-wise bar 33.

The rows of needles 24 and the yarn guides of the blocks 25 are oppositely aligned, the needles and the guides extending at an angle of approximately 30° relative to the horizontal, so as to promote closure of the needle latches.

The various means 23, 24 and 25, involved in the covering method, are controlled from a main shaft 26 receiving its rotarty drive from a motor (not shown) via pulleys 27 and a belt 28 which connect the main shaft 26 to a 1/1600 speed-reducing assembly 29.

Mounted on the main shaft 26 are two eccentric members 30 which impart reciprocatory movement to the bar 31 lengthwise of the needles 24. A further eccentric member 32 mounted on the main shaft 26 imparts to the bar 33 an angular to-and-fro movement.

The main shaft 26 transmits drive, through bevel gears 34 and 35 having a 1:2 reduction ratio, to a secondary shaft 36 on which is mounted eccentric member 37. The member 37 imparts to the angle member 23 longitudinal reciprocation.

A second eccentric member 38, mounted on the shaft 36, imparts longitudinal reciprocation to the bar 33.

As with the previously described device, the various displacements are appropriately synchronized and coordinated so as to form the chain stitches in the covering yarns 2 about the filaments 1.

Figure 8A:
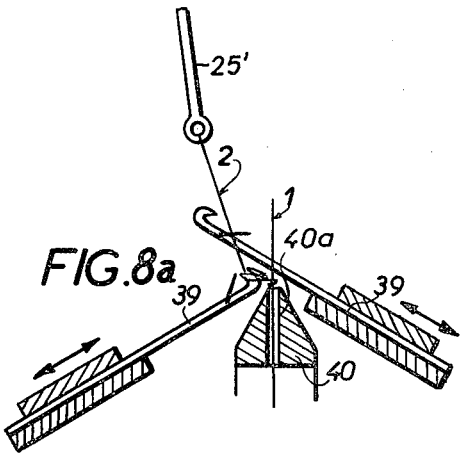
FIG. 8*a* and 8*b* are diagrammatic sectional views of a second modified version of the covering device in different positions of operation.
Figure 9:
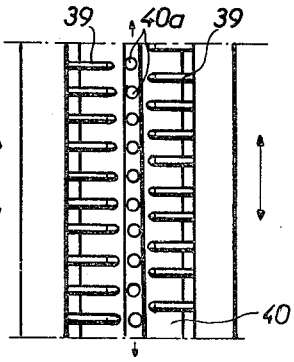
FIG. 9 is a fragmentary plan view of this second modified version.
Figure 8B:
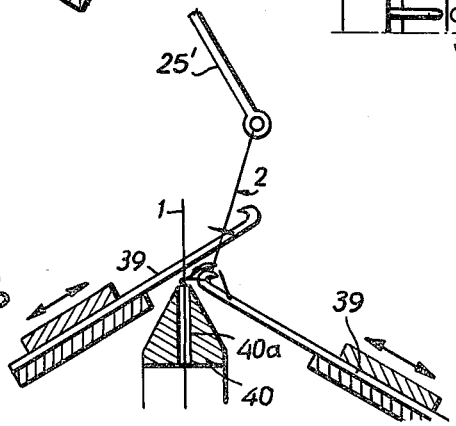

According to a further modified version of the covering device (see FIGS. 8 and 9), covering is effected by means of two rows of needles 39 positioned approximately at 30° relative to the horizontal and disposed opposite each other, the warp yarns to be covered travelling between the needles through orifices 40*a* formed in a tapered support member 40. There is imparted to member 40 longitudinal reciprocation, and to the rows of needles 39 both longitudinal reciprocation and reciprocation lengthwise of the needles. The two needles cooperate with a yarn guide 25′ similar to that as shown in FIG. 7, this yarn guide undergoing rocking movement and cooperating with the needles successively so that a chain stitch cover is formed on the warp filament. As is seen in FIGS. 8*a* and 8*b* when one needle is retracted and its latch is closed so that it engages the cover yarn 2, the other needle is extended and its latch is open so that the cover yarn is released. The needles reciprocate in the manner as shown in FIG. 8*a* and 8*b* and successively engage the cover yarn to form chain stitches around the warp yarn. It is also possible for each row of needles to be associated with a respective yarn guide and cover yarn in which case the warp yarn can be covered with two separate cover yarns.

It is not excluded in the case of any of the embodiments of the covering devices, as above described, to cover with more than two covering yarns per warp yarn. To do this, the needles are arranged in fan-like arrays on opposite sides of the warp yarns.

It is also possible to combine a plurality of rows of needles with a plurality of yarn guides, thereby making it possible to diminish the operating velocities and accelerations of the moving parts.

It should also be noted that, although the various embodiments of covering device are generally mounted on the loom so as to feed covered warp yarns directly to the weaving means thereof, it is nevertheless possible to provide an independent covering device which could be fitted on a loom or function independently thereof. In either of the latter cases, the device requires an amount of space which is small relative to that required by conventional covering devices.

It should be noted that the covering of warp yarns by successive chain or other loop stitches tends to prevent deterioration if the warp is accidently cut, since the covered yarns retain the warp yarns and prevent them from being withdrawn from the cut portion if the warp yarns are resilient, whereas in conventional i.e. helical covering, it is the warp yarns which retain the covered yarns and, if the warp yarns are cut, the covering rapidly deteriorates.

It should be further noted that the covered warp yarns have a predetermined degree of roughness and that they are more bulky in cross-section then yarns covered by helical winding. This means that woven fabric is of improved strength.

The filaments which are covered may be of natural or synthetic elastomeric or non-elastic material.

What is claimed is:

1. A device for covering warp yarns with covering yarns comprising a row of yarn guides for feeding a plurality of elastic warp yarns in parallel longitudinal direction, means supporting said yarn guides for reciprocal movement solely in a direction transversely with respect to said warp yarns, a row of needles extending adjacent said yarn guides in a direction perpendicular thereto, means supporting said needles for reciprocal movement solely in a direction lengthwise of the needles and thereby perpendicular to the reciprocal movement of the yarn guides, means for supplying covering yarns to said needles in a direction substantially parallel thereto and perpendicular to the direction of feed of the warp yarns including a row of covering yarn displacing members extending substantially parallel to said needles and perpendicularly to said yarn guides for the elastic warp yarns, means supporting the covering yarn displacing members solely for reciprocal movement along an axis parallel to the axis of reciprocal movement of the yarn guides for the warp yarn and for pivotal movement in opposite directions about the axis of reciprocal movement of the covering yarn displacing members such that the yarn displacing members cooperate with said row of needles to cover said warp yarns with said covering yarns in the form of rows of loop stitches, means for feeding the thus covered yarns to a loom including a guide proximate said needles having a guide passage for travel of the individual covered warp yarns to the loom in a direction substantially parallel to the direction of feed of the warp yarns to the warp yarn guide, drive means for moving the yarn guides and needles for forming the covered warp yarns, lateral frame members which are spaced from each other, said means supporting the covering yarn displacing members comprising a first weftwise bar which mounts said row of covering yarn displacing members and which is carried by said lateral frame members for weftwise reciprocation and for swinging to-and-fro about a weftwise axis passing through said bar, said means supporting said warp yarn guides comprising a second weftwise bar which mounts the warp yarn guides and which is carried by said lateral frame members for weftwise reciprocation, said means supporting said needles comprising a third weftwise bar which mounts said row of needles and which is carried by said lateral frame members for reciprocation lengthwise of the needles, said guide of the means for directing the covered warp yarns to the loom comprising a fourth weftwise bar which is fixedly carried by said lateral frame members, and a fifth weftwise bar spaced above said fourth weftwise bar, the fourth and fifth weftwise bars guiding the covered warp yarns therebetween.

2. Apparatus according to claim 1, wherein said row of yarn-displacing members and said row of needles are disposed at respective opposite sides of said row of warp yarn guides.

3. Apparatus according to claim 1, comprising a second row of needles supported for movement solely in a direction of reciprocation lengthwise of the needles.

4. Apparatus according to claim 1, wherein said row of warp yarn guides is a row of holes formed through a single member.

* * * * *